US010636593B2

(12) United States Patent
Chang

(10) Patent No.: US 10,636,593 B2
(45) Date of Patent: Apr. 28, 2020

(54) SILENT KEYBOARD AND KEY STRUCTURE THEREOF

(71) Applicant: Primax Electronics Ltd., Taipei (TW)

(72) Inventor: Chia-Yuan Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/168,189

(22) Filed: Oct. 23, 2018

(65) Prior Publication Data

US 2020/0051762 A1 Feb. 13, 2020

(30) Foreign Application Priority Data

Aug. 10, 2018 (TW) ..... 107127981 A

(51) Int. Cl.
*H01H 13/84* (2006.01)

(52) U.S. Cl.
CPC ..... *H01H 13/84* (2013.01); *H01H 2221/062* (2013.01)

(58) Field of Classification Search
CPC ... H01H 13/84; H01H 2221/062; H01H 13/85
USPC ..... 200/344, 345
See application file for complete search history.

(56) References Cited

U.S. PATENT DOCUMENTS 6,880,989 B2 * 4/2005 Sotome ..... G03B 21/28 200/345
7,635,821 B2 * 12/2009 Hamada ..... H01H 9/0235 200/293

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

A silent keyboard and a key structure are provided. The key structure includes a keycap, a buffering layer, a stabilizing element and a supporting plate. The keycap includes a bottom surface and a protrusion edge. The protrusion edge is disposed on a periphery of the bottom surface. The buffering layer is disposed on the bottom surface and the protrusion edge. The buffering layer includes a flat part, a raised part and plural coupling parts. The stabilizing element is located under the keycap and pivotally coupled to the coupling parts. The supporting plate is located under the keycap. The supporting plate includes a key seat, a supporting surface and plural recesses. The plural recesses are aligned with the corresponding coupling parts. While the keycap is moved toward the supporting plate, the flat part, the raised part or the plural coupling parts are subjected to deformation.

10 Claims, 3 Drawing Sheets

SILENT KEYBOARD AND KEY STRUCTURE THEREOF

FIELD OF THE INVENTION

The present invention relates to a silent keyboard and a key structure, and more particularly to a silent keyboard and a key structure using an elastic buffering layer as a contact buffering structure in order to achieve the sound-reducing and vibration-reducing purposes.

BACKGROUND OF THE INVENTION

As known, computers such as desktop computers (e.g., personal computers) or notebook computers are essential tools in our daily lives. Moreover, keyboards are important input devices of computers. Via the keyboards, users can input characters or perform control operations. Generally, a keyboard comprises plural key structures. These key structures are located at specified positions. Moreover, many electronic devices or electrical operation devices are equipped with key structures that are used as operation interfaces of performing various designated functions.

For allowing users to perform the input and control operations, the key structures of the keyboard are specially designed. That is, the key structure is returned to its original position in response to a single pressing action, and a triggering signal is generated in response to the pressing action. Due to the compressible restoring mechanism of the key structure, the tactile feel of successfully pressing the key structure for the user is enhanced. In addition, the same key structure can be used to provide the next pressing action.

As for the conventional keyboards, the key structures are classified according to the types of the switches in the key structures. For example, the key structures are classified into some types, including mechanical key structures, membrane key structures, conductive rubber key structures and contactless electrostatic capacitive key structures. Generally, the use lives, the tactile feels and the fabricating cost for different types of key structures are usually different.

Moreover, the key structure is usually equipped with a scissors-type connecting element under the keycap. Due to the scissors-type connecting element, the pressing force can be effectively and uniformly distributed. In addition, the key structure further comprises an elastic element (e.g., a spring or a rubber-dome elastic element). Due to the elastic element, the scissors-type connecting element can be returned to its original position. Consequently, the key structure can be operated repeatedly. If the key structure is only equipped with the elastic element as the restoring mechanism but not equipped with the scissors-type connecting element, the distribution of the pressing force is usually not uniform. Under this circumstance, it is difficult to build the larger-area keycap of the key structure of the keyboard. For example, the key structure with the larger-area keycap includes the "Space" key, the "Enter" key, the "Shift" key, the "Caps Lock" key or any other similar multiple key.

On the other hand, the longer key structure or the larger-sized key structure is equipped with a stabilizer bar that cooperates with the scissors-type connecting element. The stabilizer bar is an elongated shaft. In addition, the stabilizer bar is located under the keycap and arranged around the scissors-type connecting element. As the overlying keycap is depressed, the stabilizer bar allows the overall keycap to be evenly moved downwardly. Consequently, the keycap is not tilted. That is, while the keycap is depressed, one side of the keycap is not higher than another side of the keycap.

In FIGS. 1A and 1B, the cross-sectional view of a key structure 10 is shown. FIG. 1A is a schematic cross-sectional view illustrating a portion of a conventional key structure, in which the key structure is in a non-depressed state. FIG. 1B is a schematic cross-sectional view illustrating a portion of the conventional key structure, in which the key structure is in a depressed state. The key structure 10 comprises a keycap 11, a stabilizer bar 13, a hook part 15, a supporting plate 12 and a pressing post 17. The hook part 15 is located under the keycap 11. The stabilizer bar 13 is pivotally coupled to the hook part 15. The key structure 10 has a recess 14 corresponding to the hook part 15. When the keycap 11 is moved downwardly, the hook part 15 is accommodated within the recess 14. The pressing post 17 is located under the keycap 11 and aligned with a key seat 16. An elastic element and a key switch (not shown) are disposed within the key seat 16. While the keycap 11 is moved downwardly, the pressing post 17 is correspondingly descended to trigger the key switch. Moreover, the pressing post 17 is returned to its original position in response to the elastic force of the elastic element.

However, since most of the above components are made of harder materials, some drawbacks occur. For example, while the keycap of the keyboard is depressed to perform a control operation or input a character, the collisions between these components may generate noise or sound. For example, as shown in FIG. 1B, the contact, the withstanding action or the collision between a bottom surface 110 of the keycap 11 and the key seat 16, between the hook part 15 and the recess 14 or between a protrusion edge 111 of the keycap 11 and the supporting plate 12 may generate noise or sound. If the keyboard device is used in the environment requiring silence (e.g., a library or an office), the generated noise may influence other people and disturbs and inconveniences the user and other people. Moreover, the collision between components may abrade the components, and thus the key structure has a malfunction.

Therefore, there is a need of providing an improved silent keyboard and an improved key structure in order to overcome the drawbacks of the conventional technologies.

SUMMARY OF THE INVENTION

The present invention provides a silent keyboard and a key structure thereof. In accordance with a feature of the keyboard and the key structure, a buffering layer made of an elastic material is used as a contact buffering structure. While the key structure is depressed, the buffering layer is subjected to deformation. Consequently, the purpose of reducing sound and the purpose of reducing vibration are achieved.

In accordance with an aspect of the present invention, there is provided a key structure. The key structure in installed on a keyboard. The key structure includes a keycap, a buffering layer, a stabilizing element and a supporting plate. The keycap can be pressed. The keycap includes a bottom surface and a protrusion edge. The protrusion edge is disposed on a periphery of the bottom surface. The buffering layer is disposed on the bottom surface and the protrusion edge. The buffering layer includes a flat part, a raised part and plural coupling parts. The plural coupling parts are protruded from the bottom surface. The stabilizing element is located under the keycap and pivotally coupled to the plural coupling parts. The supporting plate is located under the keycap. The supporting plate includes a key seat, a supporting surface and plural recesses. The plural recesses are aligned with the corresponding coupling parts. While the keycap is moved toward the supporting plate, the flat part, the raised part or the plural coupling parts of the buffering layer collide with the key seat, the supporting surface or the corresponding recesses, and the flat part, the raised part or the plural coupling parts are subjected to deformation.

In accordance with another aspect of the present invention, there is provided a keyboard. The keyboard includes plural key structures. Each key structure includes a keycap, a buffering layer, a stabilizing element and a supporting plate. The keycap can be pressed. The keycap includes a bottom surface and a protrusion edge. The protrusion edge is disposed on a periphery of the bottom surface. The buffering layer is disposed on the bottom surface and the protrusion edge. The buffering layer includes a flat part, a raised part and plural coupling parts. The plural coupling parts are protruded from the bottom surface. The stabilizing element is located under the keycap and pivotally coupled to the plural coupling parts. The supporting plate is located under the keycap. The supporting plate includes a key seat, a supporting surface and plural recesses. The plural recesses are aligned with the corresponding coupling parts. While the keycap is moved toward the supporting plate, the flat part, the raised part or the plural coupling parts of the buffering layer collide with the key seat, the supporting surface or the corresponding recesses, and the flat part, the raised part or the plural coupling parts are subjected to deformation.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1A:
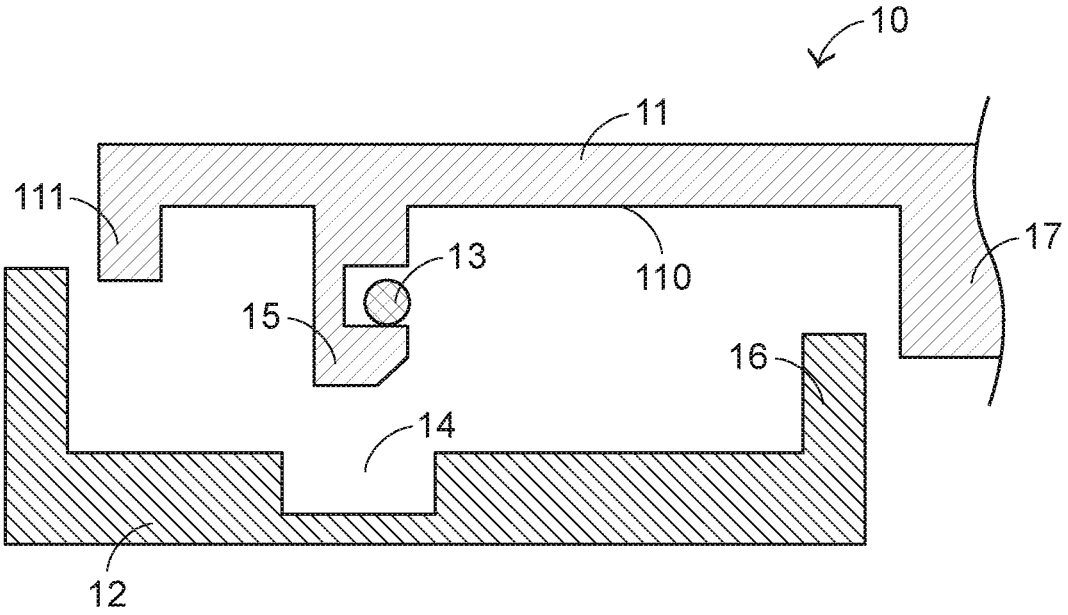
FIG.1A PRIOR ART
FIG. 1A is a schematic cross-sectional view illustrating a portion of a conventional key structure, in which the key structure is in a non-depressed state.
Figure 1B:
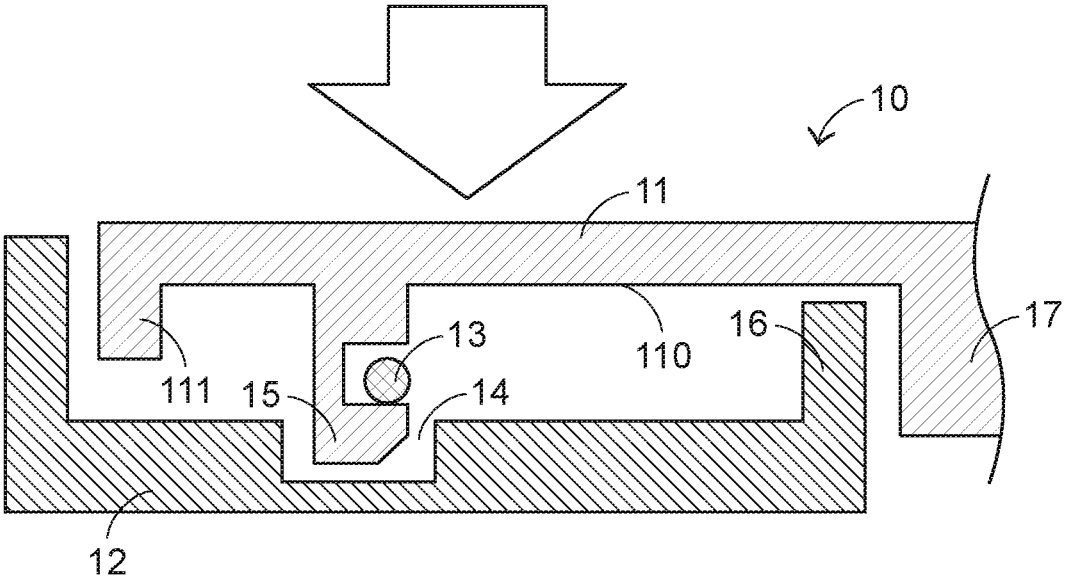
FIG.1B PRIOR ART
FIG. 1B is a schematic cross-sectional view illustrating a portion of the conventional key structure, in which the key structure is in a depressed state.
Figure 2A:
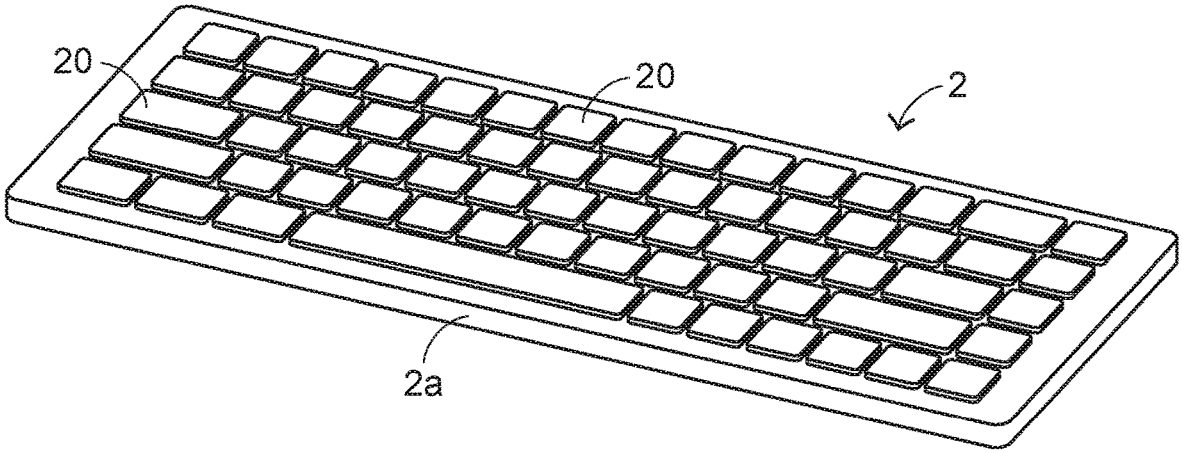
FIG. 2A is a schematic perspective view illustrating a silent keyboard according to an embodiment of the present invention.
Figure 2B:
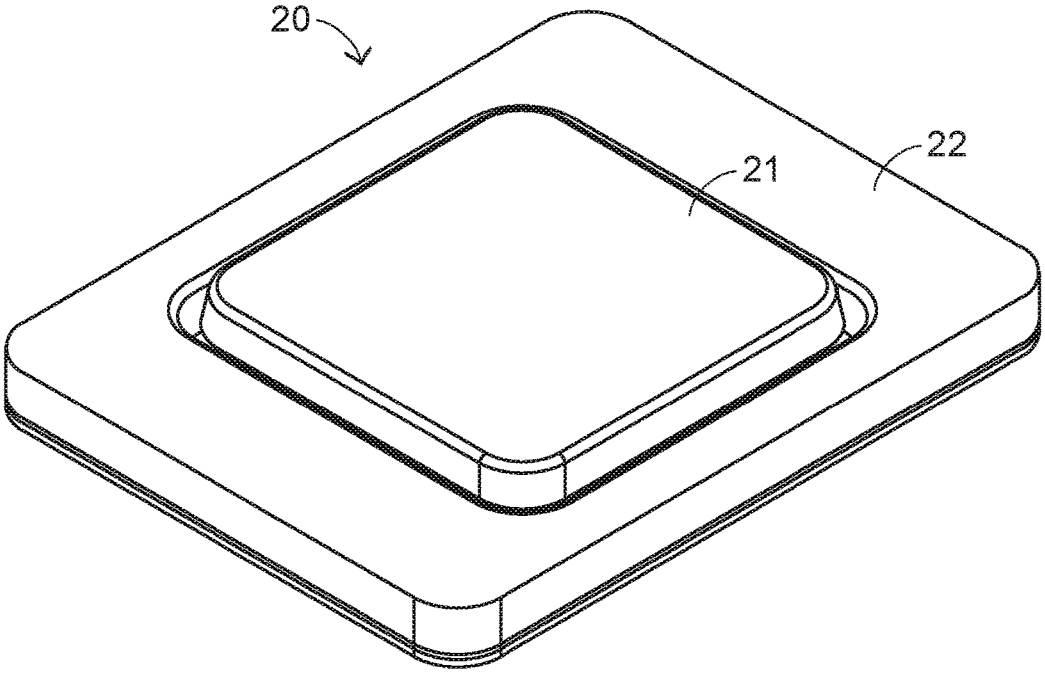
FIG. 2B is a schematic perspective view illustrating a key structure of the silent keyboard according to the embodiment of the present invention.

Hereinafter, the examples of a silent keyboard and a key structure will be illustrated with reference to FIGS. 2A and 2B. FIG. 2A is a schematic perspective view illustrating a silent keyboard according to an embodiment of the present invention. FIG. 2B is a schematic perspective view illustrating a key structure of the silent keyboard according to the embodiment of the present invention. As shown in FIG. 2A, the keyboard 2 comprises plural key structures 20. These key structures 20 are distributed on the designated positions of the keyboard 2 according to the character arrangements or their functions.

In an embodiment, the keyboard 2 is a standalone peripheral device of a desktop computer (or a personal computer). It is noted that the applications of the keyboard 2 are not restricted. For example, the concepts of the silent keyboard and the key structure of the present invention can be applied to a notebook computer.

As shown in FIGS. 2A and 2B, the keyboard 2 further comprises a casing 2*a*. The plural key structures 20 comprise respective supporting plates 22. The casing 2*a* is defined by these supporting plates 22 collaboratively. That is, each of the supporting plates 22 is a portion of the casing 2*a*. The key structures 20 are assembled with the designated positions of the casing 2*a*. Each key structure 20 comprises a keycap 21. The keycap 21 is exposed outside to be depressed. It is noted that the size and shape of each key structure 20 may be varied according to the practical requirements. In the embodiment of FIG. 2B, the key structure 20 has the size of the ordinary character key. In some other embodiments, the key structure 20 is a larger-sized key, for example the key "Space" or any other appropriate multiple key.

In the embodiment of FIG. 2B, the keycap 21 is not always enclosed by the supporting plate 22. According to the positions of the key structures or the type of the applied standalone keyboard or keyboard module, the keycap 21 is not always enclosed by the supporting plate 22. The supporting plate 22 is located under the corresponding keycap 21. The arrangement of the supporting plate 22 of the key structure 20 is presented herein for purpose of illustration and description only.

Figure 3A:
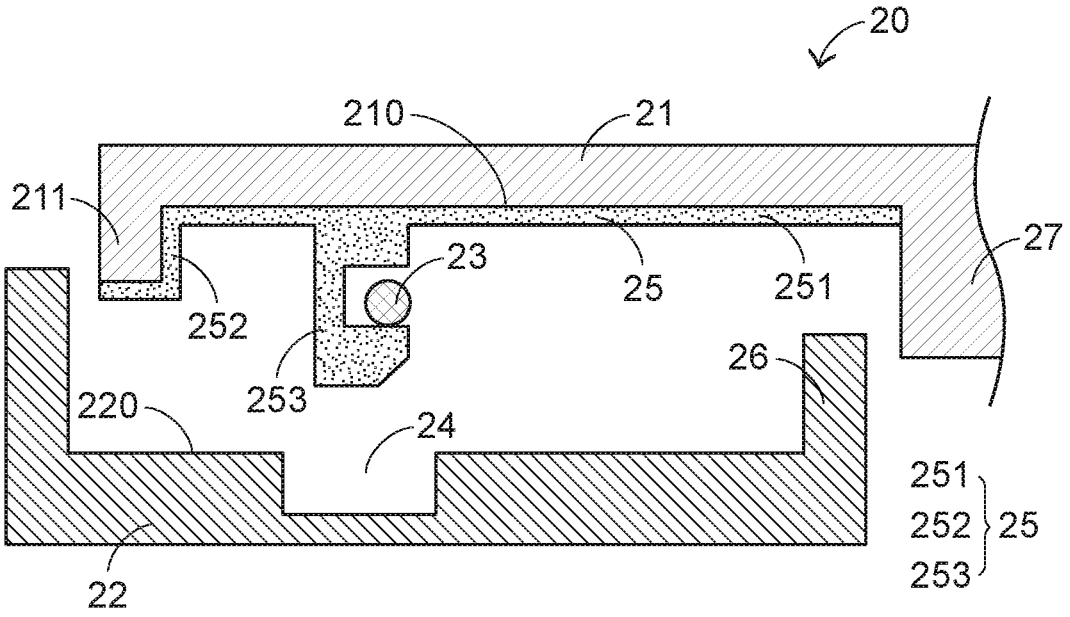
FIG. 3A is a schematic cross-sectional view illustrating a portion of a key structure according to the embodiment of the present invention, in which the key structure is in a non-depressed state.
Figure 3B:
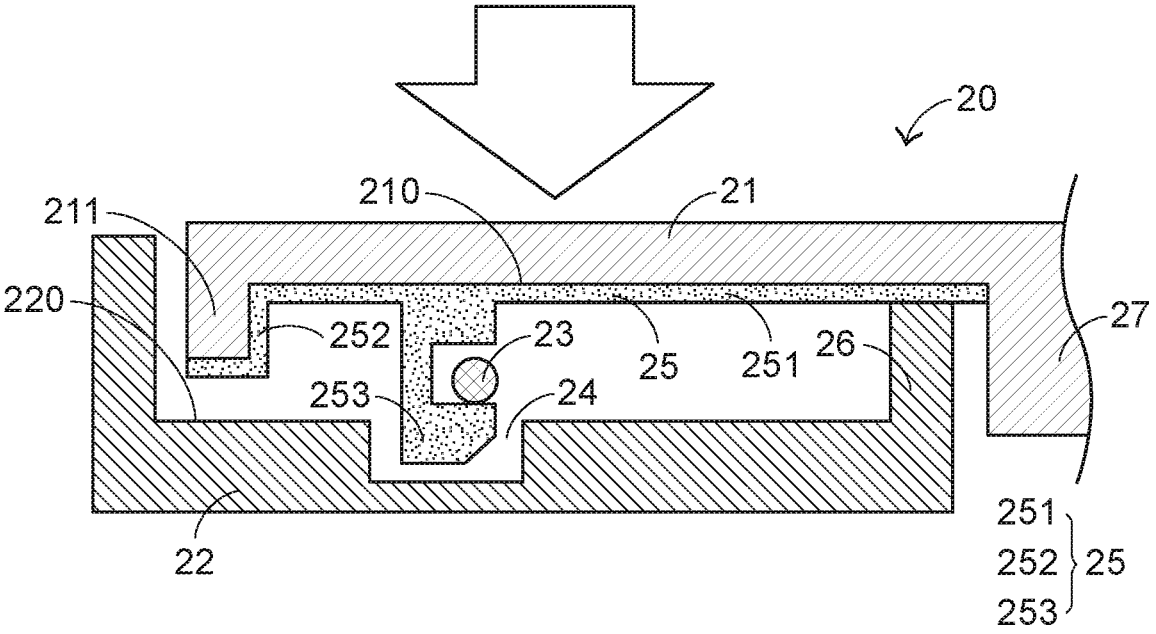
FIG. 3B is a schematic cross-sectional view illustrating a portion of the key structure according to the embodiment of the present invention, in which the key structure is in a depressed state.

In FIGS. 3A and 3B, the cross-sectional view of the key structure 20 is shown. FIG. 3A is a schematic cross-sectional view illustrating a portion of a key structure according to the embodiment of the present invention, in which the key structure is in a non-depressed state. FIG. 3B is a schematic cross-sectional view illustrating a portion of the key structure according to the embodiment of the present invention, in which the key structure is in a depressed state. As shown in FIGS. 3A and 3B, the keycap 21 comprises a bottom surface 210 and a protrusion edge 211. The protrusion edge 211 is disposed on a periphery of the bottom surface 210. Moreover, the key structure 20 further comprises a buffering layer 25 and a stabilizing element 23. The buffering layer 25 is disposed on the bottom surface 210 and the protrusion edge 211. The stabilizing element 23 is located under the keycap 21.

The buffering layer 25 comprises a flat part 251, a raised part 252 and plural coupling parts 253. The plural coupling parts 253 are protruded from the bottom surface 210. The flat part 251 is distributed on the bottom surface 210. The raised part 252 is distributed on the protrusion edge 211. The stabilizing element 23 is pivotally coupled to the plural coupling parts 253. In the cross-sectional view of FIGS. 3A and 3B, only a half of the key structure 20 is shown. Consequently, only one coupling part 253 is shown. The plural coupling parts 253 are arranged symmetrically. In other words, the other half of the key structure 20 has the identical structure.

In an embodiment, the stabilizing element 23 is a scissors-type connecting element, a stabilizer bar or an assembly of a scissors-type connecting element and a stabilizer bar. In FIGS. 3A and 3B, only one stabilizing element is shown. That is, only a portion of a stabilizer bar is shown. A scissors-type connecting element is pivotally coupled to the coupling parts 253, or a stabilizer bar is pivotally coupled to the coupling parts 253. Generally, the ordinary key structure is equipped with the scissors-type connecting element for homogenizing the pressing force of the user. In case that the key structure 20 is a larger-sized key (e.g., the key "Space" or any other appropriate multiple key), the stabilizer bar is located under the keycap and arranged around the scissors-type connecting element. Under this circumstance, the number of the coupling parts is correspondingly increased.

The key structure 20 further comprises a pressing post 27, an elastic element (not shown) and a key switch (not shown). The supporting plate 22 comprises a key seat 26, a supporting surface 220 and plural recesses 24. Particularly, the pressing post 27 is disposed on the bottom surface 210 and aligned with the key seat 26. The elastic element is located under the pressing post 27. In response to a pressing force, the elastic element is subjected to compressible deformation. After the pressing force is released, the elastic element is restored to its original state in response to a restoring force. In other words, the pressing post 27 is movable back and forth between an original positon (see FIG. 3A) and a pressed position (see FIG. 3B). As the coupling parts 253 are moved downwardly, the coupling parts 253 are accommodated within the recesses 24.

The elastic element is a spring, a resilience sheet or a rubber dome and used as a restoring mechanism of the key structure. In other words, the key structure 20 is applied to a mechanical type, a membrane type or any other appropriate type of key structure or keyboard. The key switch is located under the pressing post 27. When the key switch is pressed by the pressing post 27, the key switch is triggered to generate a key signal. In an embodiment, the elastic element and the key switch are disposed within the key seat 26. According to the type of the key structure or the keyboard, the design of the underlying circuit or the key switch may be varied. The design of the underlying circuit or the key switch is well known to those skilled in the art, and is not redundantly described herein.

In accordance with a feature of the key structure 20 of the present invention, the buffering layer 25 with the elastic property is located under the keycap 21 (i.e., disposed on the bottom surface 210) to achieve the purpose of reducing sound and the purpose of reducing vibration. Please refer to FIGS. 3A and 3B again. With regard to the relative positions, the recesses 24 are aligned with the corresponding coupling parts 253. The key seat 26 is aligned with the flat part 251. The supporting surface 220 is aligned with the raised part 252. The buffering layer 25 is arranged between the keycap 21 and the supporting plate 22. In addition, the buffering layer 25 is movable upwardly or downwardly with the keycap 21.

For example, the associated components have specified sizes. While the keycap 21 is moved toward the supporting plate 22 from the original positon (see FIG. 3A) to the pressed position (see FIG. 3B), the flat part 251, the raised part 252 or the plural coupling parts 253 of the buffering layer 25 collide with the key seat 26, the supporting surface 220 or the corresponding recesses 24. Consequently, the buffering layer 25 is subjected to deformation. Since the buffering layer 25 is used as a buffering contact structure between associated components or structures, the generated deformation can effectively alleviate the collision force and reduce the noise or sound.

Preferably but not exclusively, the buffering layer 25 is made of rubber, silicone, polyester, resin or any other appropriate elastic material. For example, the buffering layer 25 is made of thermoplastic elastomer (TPE). In accordance with a feature, the selected material is formed as the buffering layer 25 with the desired shape and the proper hardness by an injection molding process. For achieving the sound-reducing and vibration-reducing purposes, the buffering layer 25 is made of a soft material to provide proper elasticity. In addition, the material of the buffering layer 25 has the anti-wear and durable properties and is not suffered from permanent deformation (i.e., not unrecoverable).

As shown in FIG. 3B, the collision between the raised part 252 and the supporting surface 220 is not obvious. However, in case that the coupling parts 253 collide with the recesses 24 to result in obvious deformation and the pressing force exerted on the keycap 21 is slightly deviated, the collision between the raised part 252 and the supporting surface 220 is possibly generated. It is noted that the sizes of the associated components shown on FIGS. 3A and 3B are not restricted. That is, the sizes of the associated components and the possible deformation extents of different parts of the buffering layer 25 are specially designed as long as the action of depressing and triggering the key switch is not hindered.

In an embodiment, the keycap 21 and the buffering layer 25 are made of the same type of material (e.g., rubber) but their hardness values are different. That is, the hardness of the buffering layer 25 is lower than the hardness of the keycap 21. A fabricating method will be described as follows. Firstly, a harder material is injected into a mold to form the keycap 21. After the keycap 21 is formed, a softer material is injected into the same mold to form the buffering layer 25. Consequently, the overall structure of the keycap 21 and the buffering layer 25 is directly formed. That is, the flat part 251 is formed on the bottom surface 210, and the raised part 252 is formed on the protrusion edge 211. In addition, the plural coupling parts 253 are arranged between the flat part 251 and the raised part 252.

It is noted that numerous modifications and alterations may be made while retaining the teachings of the invention. For example, in another embodiment, the keycap 21 and the buffering layer 25 are made of different materials. Similarly, the hardness of the buffering layer 25 is lower than the hardness of the keycap 21. The keycap 21 and the buffering layer 25 are individually produced by using different molds to perform an injection molding process. Then, the buffering layer 25 is adhered on the bottom surface 210 and the protrusion edge 211 of the keycap 21.

In some other embodiments, the pressing post 27 is integrally formed with the keycap 21. That is, the pressing post 27 and the keycap 21 are made of the same material. Moreover, the pressing post 27 and the keycap 21 are collaboratively produced by using the same mold to perform an injection molding process. As shown in FIGS. 3A and 3B, the buffering layer 25 is not distributed on the pressing post 27. The flat part 251 is distributed on the entire of the bottom surface 210. In addition, a perforation is formed in a middle region of the flat part 251. After the pressing post 27 is penetrated through the perforation, the pressing post 27 is contacted with the elastic element. In another embodiment, the pressing post and the keycap are separate components. After the pressing post is disposed on the corresponding elastic element, the pressing post is contacted with the bottom surface of the keycap in response to the elasticity of the elastic element.

In accordance with the conventional technology, the component made of the thermoplastic material by the injection molding process has a larger thickness, for example at least about 0.6 mm. Consequently, the buffering layer and the key structure produced by this method are not suitably applied to the general slim-type keyboard. For solving this problem, the buffering layer is formed and arranged by other methods.

In an embodiment, the buffering layer is made of silicone, and the buffering layer is disposed on the bottom surface and the protrusion edge by a hot press process. In a fabricating method, a harder material is firstly injected into the mold to form the keycap, then the silicon is thermally pressed by a hot press machine with the corresponding mold to form the flat part, the raised part and the coupling parts, and finally the keycap and the buffering layer are combined together by a welding process. Consequently, the buffering layer is formed. The buffering layer made of silicone has the smaller thickness. For example, the flat part is about 0.3 mm.

If the buffering layer formed by the hot press process is too thick, the buffering layer made of rubber is formed on the bottom surface and the protrusion edge by a spraying process. In a fabricating method, a harder material is firstly injected into the mold to form the keycap, and then the rubber in a liquid state is sprayed on the bottom surface and the protrusion edge of the keycap to form the flat part and the raised part. The coupling parts are relatively longer. After the coupling parts are formed by the mold, the coupling parts are adhered onto the flat part and the raised part and thus the buffering layer is produced. Since the buffering layer is produced by spraying the liquid rubber, the buffering layer is thinner. For example, the thickness of the flat part is in the range between 0.1 mm and 0.2 mm.

From the above descriptions, the present invention provides the silent keyboard and the key structure. The elastic property of the buffering layer is effectively utilized. While the key structure is depressed, the buffering layer is subjected to deformation and used as a buffering contact structure. Consequently, the sound-reducing purpose and the vibration-reducing purpose are achieved. In addition, the elastic material of the buffering layer has the anti-wear and durable properties and is not suffered from permanent deformation (i.e., not unrecoverable). Consequently, the associated components are not readily damage in response to the collision. In other words, the silent keyboard and the key structure of the present invention can overcome the drawbacks of the conventional technologies while achieving the objects of the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure installed on a keyboard, the key structure comprising:

a keycap to be pressed, wherein the keycap comprises a bottom surface and a protrusion edge, and the protrusion edge is disposed on a periphery of the bottom surface;

a buffering layer disposed on the bottom surface and the protrusion edge, wherein the buffering layer comprises a flat part, a raised part and plural coupling parts, and the plural coupling parts are protruded from the bottom surface;

a stabilizing element located under the keycap and pivotally coupled to the plural coupling parts, wherein the stabilizing element is a scissors-type connecting element, a stabilizer bar, or and assembly of a scissors-type connecting element and a stabilizer bar; and a supporting plate located under the keycap, and comprising a key seat, a supporting surface and plural recesses, wherein the plural recesses are aligned with the corresponding coupling parts, wherein while the keycap is moved toward the supporting plate, the flat part, the raised part or the plural coupling parts of the buffering layer collide with the key seat, the supporting surface or the corresponding recesses, and the flat part, the raised part or the plural coupling parts are subjected to deformation.

2. The key structure according to claim 1, wherein the flat part is distributed on the bottom surface, and the raised part is distributed on the protrusion edge.

3. The key structure according to claim 1, wherein the key structure further comprises:

a pressing post disposed on the bottom surface and aligned with the key seat.

4. The key structure according to claim 3, wherein the pressing post is integrally formed with the keycap.

5. The key structure according to claim 1, wherein the buffering layer is made of rubber, silicone, polyester, resin or an elastic material.

6. The key structure according to claim 1, wherein the keycap and the buffering layer are made of the same material or different materials, a hardness of the buffering layer is lower than a hardness of the keycap, and the keycap and the buffering layer are formed by an injection molding process.

7. The key structure according to claim 1, wherein the buffering layer is adhered on the bottom surface and the protrusion edge.

8. The key structure according to claim 1, wherein the buffering layer is formed on the bottom surface and the protrusion edge by a hot press process.

9. The key structure according to claim 1, wherein the buffering layer is formed on the bottom surface and the protrusion edge by a spraying process.

10. A silent keyboard comprising plural key structures, each key structure comprising:

a keycap to be pressed, wherein the keycap comprises a bottom surface and a protrusion edge, and the protrusion edge is disposed on a periphery of the bottom surface;

a buffering layer disposed on the bottom surface and the protrusion edge, wherein the buffering layer comprises a flat part, a raised part and plural coupling parts, and the plural coupling parts are protruded from the bottom surface;

a stabilizing element located under the keycap and pivotally coupled to the plural coupling parts, wherein the stabilizing element is a scissors-type connecting element, a stabilizer bar, or an assembly of a scissors-type connecting element and a stabilizer bar; and a supporting plate located under the keycap, and comprising a key seat, a supporting surface and plural recesses, wherein the plural recesses are aligned with the corresponding coupling parts, wherein while the keycap is moved toward the supporting plate, the flat part, the raised part or the plural coupling parts of the buffering layer collide with the key seat, the supporting surface or the corresponding recesses, and the flat part, the raised part or the plural coupling parts are subjected to deformation.

* * * * *